US009228737B2

(12) United States Patent
Steinmann et al.

(10) Patent No.: US 9,228,737 B2
(45) Date of Patent: Jan. 5, 2016

(54) ADJUSTABLE HEIGHT CANDLE HOLDER JAR

(71) Applicants: Nicholas Legakis, West Islip, NY (US); Loretta M Legakis, West Islip, NY (US); Linda Edwards, Islip, NY (US)

(72) Inventors: Ronald A. Steinmann, Islip, NY (US); Nicholas Legakis, West Islip, NY (US); Loretta M Legakis, West Islip, NY (US); Linda Edwards, Islip, NY (US)

( * ) Notice: Subject to any disclaimer, the term of this patent is extended or adjusted under 35 U.S.C. 154(b) by 0 days.

(21) Appl. No.: 14/528,608

(22) Filed: Oct. 30, 2014

(65) Prior Publication Data

US 2015/0064634 A1 Mar. 5, 2015

Related U.S. Application Data

(63) Continuation of application No. 12/218,603, filed on Jul. 16, 2008, now abandoned.

(60) Provisional application No. 60/961,296, filed on Jul. 20, 2007.

(51) Int. Cl.

| | |
|---|---|
| ***F23D 3/16*** | (2006.01) |
| ***F21V 35/00*** | (2006.01) |
| ***F21V 21/12*** | (2006.01) |

(52) U.S. Cl.

CPC ..... *F21V 35/00* (2013.01); *F21V 21/12* (2013.01)

(58) Field of Classification Search

CPC ..... F21V 35/00

USPC ..... 431/289, 290

See application file for complete search history.

(56) References Cited

U.S. PATENT DOCUMENTS

| | | | | | |
|---|---|---|---|---|---|
| 1,981,627 | A | * | 11/1934 | Merriman | 248/346.11 |
| 3,388,960 | A | * | 6/1968 | Cangialosi | 431/288 |
| 3,743,473 | A | * | 7/1973 | Von Suskil | 431/297 |
| 5,422,129 | A | * | 6/1995 | Draddy | 426/115 |
| D371,213 | S | * | 6/1996 | Hardy et al. | D26/9 |
| 5,930,951 | A | * | 8/1999 | Wong | 47/66.1 |
| 6,036,024 | A | * | 3/2000 | Seidler | 206/780 |
| 6,065,960 | A | * | 5/2000 | Hardy | 431/294 |
| 6,120,283 | A | * | 9/2000 | Cousins | 431/289 |
| 6,129,771 | A | * | 10/2000 | Ficke et al. | 44/275 |
| 6,318,575 | B1 | * | 11/2001 | Lillelund et al. | 220/4.24 |
| D554,779 | S | * | 11/2007 | Derges | D26/9 |
| 7,614,876 | B1 | * | 11/2009 | Ward-Kubik | 431/289 |
| 7,798,808 | B2 | * | 9/2010 | Kleve | 431/253 |
| D634,038 | S | * | 3/2011 | Ritzenhoff | D26/22 |
| 2002/0098456 | A1 | * | 7/2002 | Freeman et al. | 431/291 |
| 2005/0214704 | A1 | * | 9/2005 | Pappas et al. | 431/126 |
| 2005/0227193 | A1 | * | 10/2005 | Lin | 431/291 |
| 2008/0070174 | A1 | * | 3/2008 | Moeller | 431/289 |

FOREIGN PATENT DOCUMENTS

| | | | | |
|---|---|---|---|---|
| DE | 3302591 | A1 * | 8/1984 | F21V 35/00 |

* cited by examiner

*Primary Examiner* — Steven B McAllister
*Assistant Examiner* — Frances F Hamilton
(74) *Attorney, Agent, or Firm* — Alfred M. Walker

(57) ABSTRACT

A combination package of an adjustable height candle holder jar and poured wax candle therein comprising a plurality of stacked, removable rings forming an adjustable height jar atop a closed bottom ring, and with a too ring. The jar is filled with scented candle wax with a typical wick in the center.

6 Claims, 4 Drawing Sheets

ADJUSTABLE HEIGHT CANDLE HOLDER JAR

RELATED APPLICATIONS

This application is a continuation of U.S. application Ser. No. 12/218,603 filed on Jul. 16, 2008, which '085 application claims priority from U.S. Provisional Appln. No. 60/961,296, filed Jul. 20, 2007. These applications are incorporated by reference herein.

FIELD OF THE INVENTION

The present invention relates to height adjustable containers for consumable objects, such as candles.

BACKGROUND OF THE INVENTION

Tall jars of scented wax candles are popular gift and decorating items. In operation, the wick is simply lighted within the jar in which it was purchased as the wax is adhered to its interior. When the candle is relatively new, it is easy to light and keep burning since the flame is near the open top end. As the candle is used on several occasions, the wax level inside the jar gets lower making the wick more difficult to light unless long matchsticks or gas lighters are used. Also, the flame does not glow as brightly since the exposure to oxygen enriched air is more limited as the level goes down.

U.S. Pat. No. 6,065,960 of Hardy relates to a layered glass candle holder with a plurality of glass layers. As the candle within is consumed, ring layers can be removed to place the wick closer to the top open surface, but this is not the intent of the invention. Hardy's candle holder is mainly a decorative device which may have layers of different colors permitting the consumer to rearrange these at will. The candle is preferably spaced away from the inner walls of the ring layers, and there is no notion of a cohesive jar having compression fitted rings which can be factory filled with scented wax, except for a glued, non-adjustable alternate embodiment in Hardy's device. Hardy's joints are preferably complementary knobs and recesses, which would hold the rings laterally, but would not be as tight in the vertical axis as interchangeable compression friction fitted joints or threaded joints between the rings.

The prior art does not reveal an adjustable candle holder jar which can be factory filled with scented wax, sealed with a cover and have stacked compression fitted friction or threaded fitted rings in stages which can be removed to form an adjustable height candle holder.

OBJECTS OF THE INVENTION

It is therefore an object of the present invention to provide a an adjustable candle holder jar which can be factory filled with scented wax, sealed with a cover and have stacked rings in stages which can be removed to form an adjustable height candle holder.

It is also an object of the present invention to provide an adjustable height container for consumable items, such as food.

It is also an object of the present invention to provide an adjustable height container for a collection of depletable items, such as hardware fasteners, where the height of the collection of items changes as the supply of items is exhausted during consumption or use.

Other objects which become apparent from the following description of the present invention.

SUMMARY OF THE INVENTION

In keeping with these objects and others which may become apparent, the present invention is an adjustable height candle jar optionally sold with a candle, known in the trade as "STAGE GLOW CANDLE"™, which has a stack of accurately fitted rings forming the side atop a closed bottom section. The top ring is somewhat flared out and can accept a close fitted cap. The jar is intended to be factory filled with scented candle wax with a typical wick in the center.

In the preferred embodiment the jar of this invention can be manufactured of transparent or translucent and colored polycarbonate, VO or V2 polystyrene; its dimensions are a major diameter of approximately 4" and a height of about 6.6" to accommodate 20 ounces of wax. Other materials such as metal or glass can also be used.

It is noted that the jar is a stable structure as assembled with its various layers. Pouring hot wax inside creates a very robust package for transport and sales display after the wax solidifies; yet upper stages can be easily pulled off as the candle is consumed.

The same jar structure (perhaps in different sizes and height/diameter ratio) can be used to serve finger food items such as nuts, chips or candy. As the contents are consumed, upper layers are removed to facilitate easy reach down to the bottom of the jar. Even a collection of depletable items, such as hardware fasteners, can be likewise packaged, such as ajar of nails or screws, so that the user does not have to reach into the bottom of a tall jar to remove remaining items. Additionally, the jar can increase in size for items which are added in quantity, such as a collection of coins or other items which can increase in quantity over time.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

The adjustable height candle holder jar of this invention is shown in detail in FIGS. 1-6. It is shown in the configuration of the preferred embodiment, but variations in relative diameter/height ratio, decorative features, and number of intermediate stage rings can all be adjusted for particular applications without deviating from the salient features.

Figure 1:
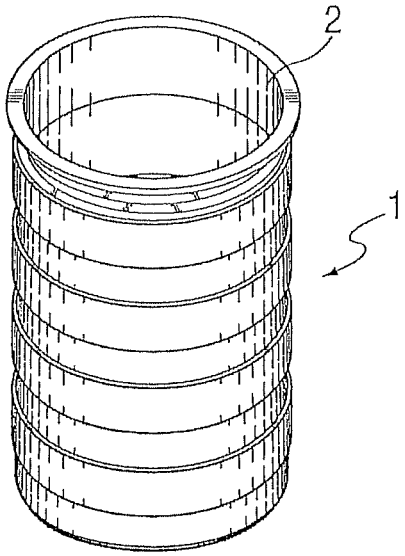
FIG. 1 is an upright perspective view of the adjustable height candle holder jar of this invention showing the open interior.

FIG. 1 shows jar 1 in an upright position showing an open top end with accessible interior 2.

Figure 2:
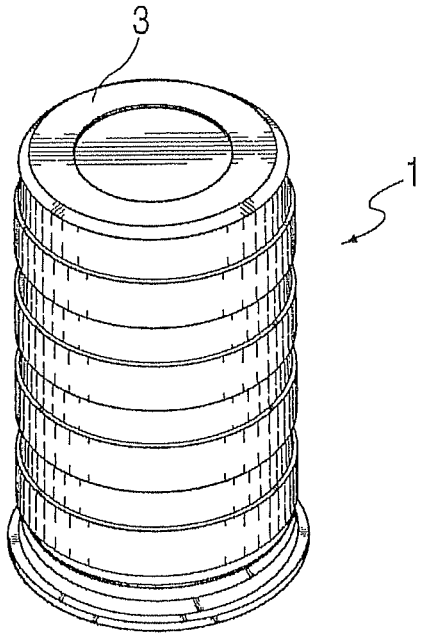
FIG. 2 is a perspective view of an inverted jar of FIG. 1 showing the closed bottom surface.
Figure 4:
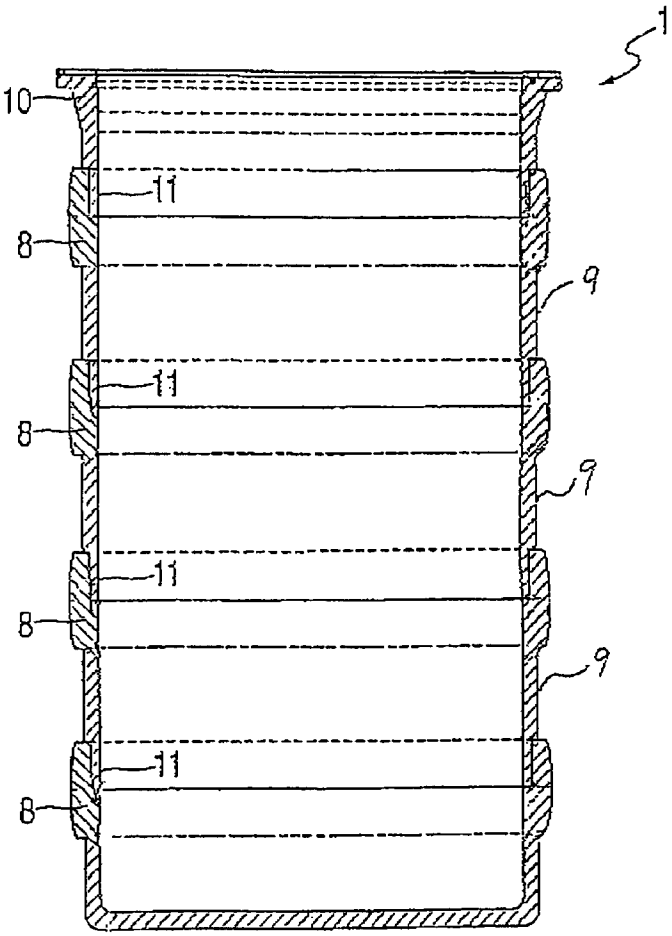
FIG. 4 is a side central cross section of an assembled jar.

FIG. 2 shows jar 1 in an inverted position showing its closed bottom surface 3.

Figure 3:
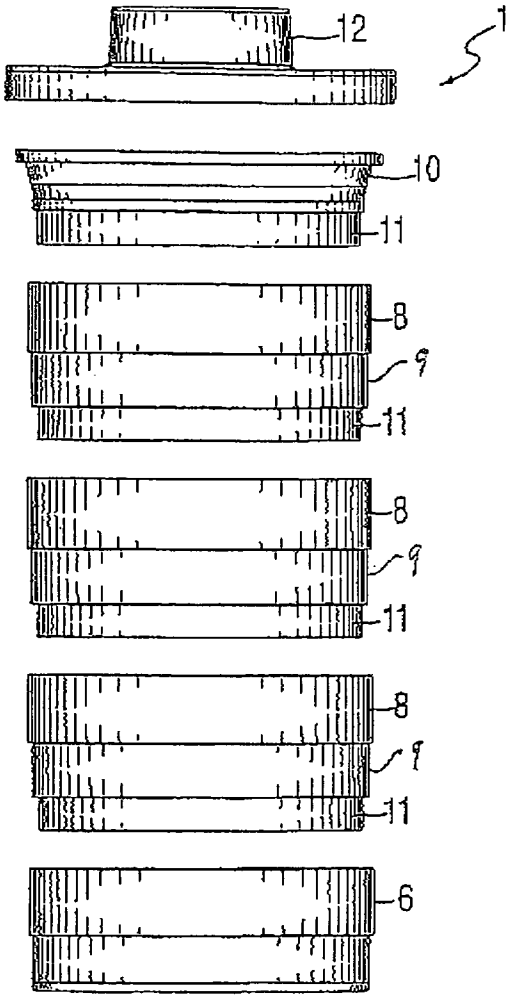
FIG. 3 is an exploded side elevation of the jar of this invention showing the various layers.

FIG. 3 shows an exploded view of jar 1 with optional cover 12. The slightly flared top ring 10 compression frictionally fits into the top of intermediate ring 8 by virtue of fitted sleeve extension 11. All three intermediate rings 8 fit into each other with their own sleeve extensions 11. Bottom intermediate ring 8 fits into sealed bottom section 6 with its sleeve extension 11. The fit of all sections (except cover 12) is shown in detail in the cross section of FIG. 4. The compression friction fitting forms a tight, but height adjustable jar about a vertical axis, with removable rings. Each intermediate ring includes an outer annular wall made up of a respective upper section 8 and a lower section, with the lower section having a central portion 9 and a respective lower sleeve extension 11.

Figure 6:
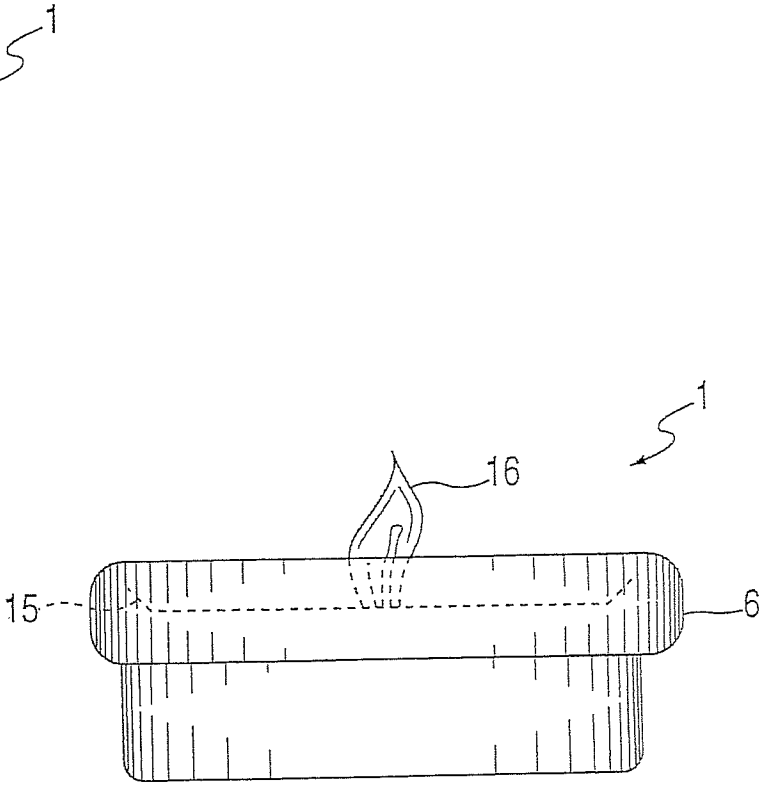
FIG. 6 is a side view of the same candle after it has burned down to a height requiring only the base section; and, FIG. 7 is a side view of an alternate threaded embodiment.
Figure 5:
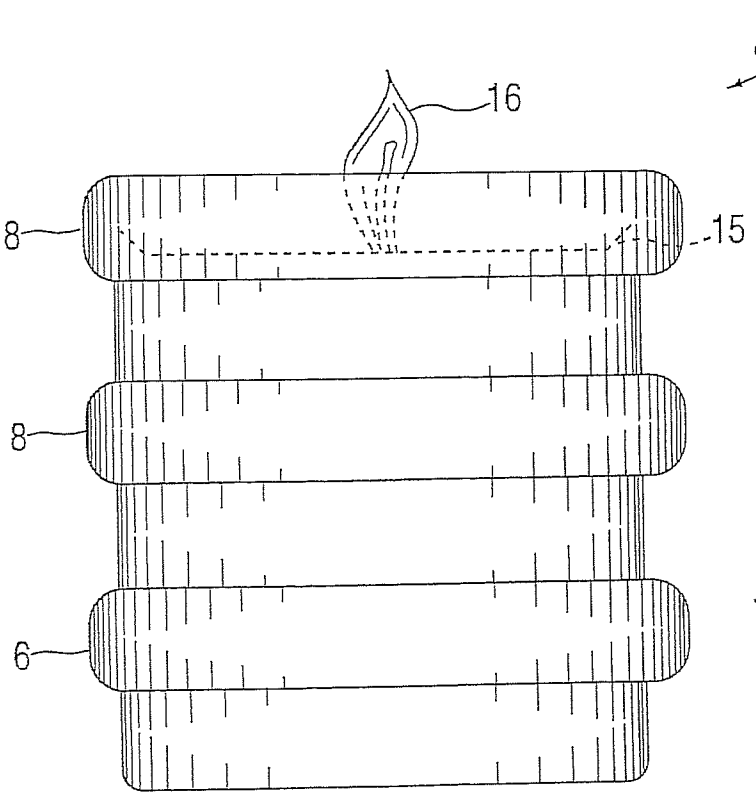
FIG. 5 is a side view of a jar of this invention with a burning candle of a height compatible with a bottom and two intermediate stages.

FIGS. 5 and 6 show two views of a candle within the adjustable candle holder jar 1 of this invention as it is consumed from an intermediate size to a very low height.

In FIG. 5, two intermediate sections 8 atop bottom section 6 are shown serving a candle with wax level at dashed line 15. It is noted that a single wick with flame 16 is adjacent to the open top end; it is easy to blow out and relight. It also burns well being adjacent to a ready supply of fresh air. Instead of a single wick as shown in FIG. 5, it is further noted that optionally two or more wicks can be used to produce multiple flames 16. It is also noted that top intermediate section 8 can be replaced optionally by flared top ring 10 and further optionally with cover 12.

In FIG. 6, the candle has been consumed to such a low level that only bottom section 6 is used to house it, yet it still burns well after the two intermediate sections 8 from FIG. 5 are removed.

Figure 7:
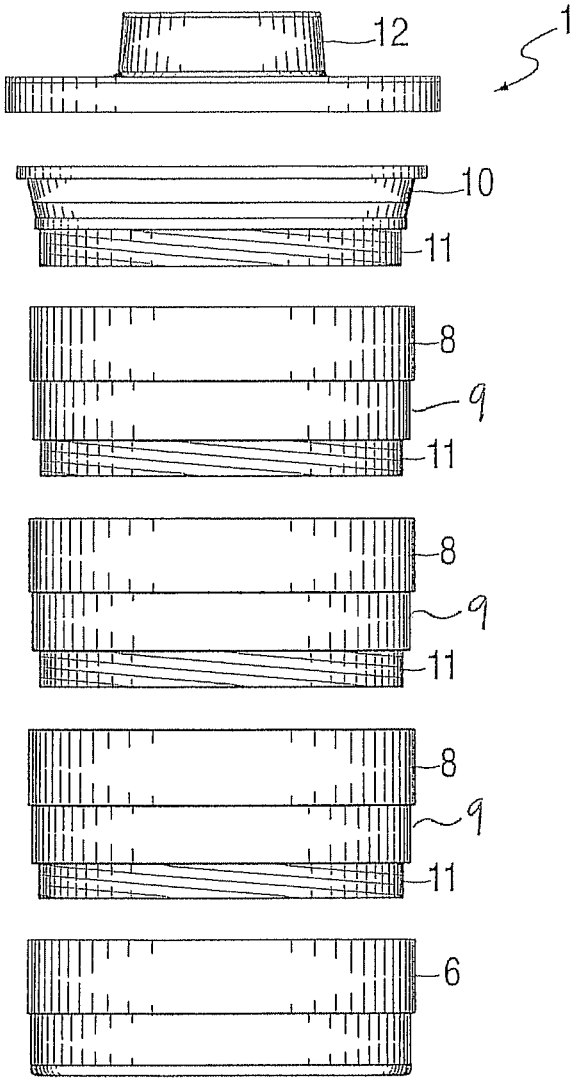

FIG. 7 shows an alternate embodiment using threaded joints 11 instead of compression frictionally fitted joints 11 between rings 8.

The aforementioned drawings show the jar 1 decreasing in size. This would be applicable for melting candles, or for a collection of depletable items, such as a collection of discrete food or hardware items. It is noted that the jar 1 can alternatively increase in size for items which increase their height in size, such as an increasing collection of change of coins which increases in height as more coinage is added.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

The invention claimed is:

1. A combination package of an adjustable candle holder jar and poured wax candle therein comprising:

said package combining a plurality of stacked, removable rings forming a height adjustable jar containing a poured wax candle therein;

said rings are shaped and assembled to form a smooth inner vertical surface of said jar adapted to receive poured wax forming a solidified poured wax candle therein, said rings being compression (i.e. frictionally) fitted together to form a tight, height adjusted jar about a vertical axis;

said rings including a bottom ring, a plurality of intermediate rings, and a top ring;

said bottom ring, said plurality of intermediate rings and said top ring each having a hollow interior collectively forming said accessible hollow interior of said jar having said smooth inner vertical surface of said jar to accommodate said poured wax candle;

each intermediate ring comprising an outer annular wall made up of an upper section and a lower section, said lower section having a central portion and a lower sleeve extension, said upper section having a shaped inner surface to receive the lower sleeve extension of a ring directly above, said upper section having a larger outer diameter than said central portion and said lower sleeve extension of said lower section;

said plurality of intermediate rings forming an outer shape of said jar being of alternating outer surfaces of said upper sections and said central portions of said lower sections presenting a ribbed outer surface of said jar;

said bottom ring comprising a flat bottom surrounded by an annular wall forming an open package for holding said solidified poured wax candle, said annular wall including an upper section having a shaped inner surface for receiving the lower sleeve extension of an intermediate ring immediately above;

said bottom ring, said intermediate rings and said top ring forming said package comprising said solidified poured wax candle within said candle holder jar, said package having a height adapted to be adjusted by addition or removal of intermediate rings to compensate for different size candles and change in candle height during use;

all of said rings being fitted vertically adjacent together to form a height adjustable jar about a vertical axis; and wherein said lower sleeve extension of each of said rings has a cylindrical outer surface, said upper portion of each of said rings has a cylindrical inner surface, and each of said lower sleeve extensions forms a compression (i.e. friction) fit with said upper section into which it is received.

2. The combination package of claim 1 in which said central portion has an outer diameter less than said upper section and a greater outer diameter than said lower sleeve extension.

3. The combination package of claim 2 in which a bottom of said central portion has a downwardly facing and outwardly extending annular shoulder abutting a top edge of the upper section of the ring immediately below.

4. The combination package of claim 3 having an upwardly facing and inwardly extending annular shoulder formed in said upper section located so that a bottom surface of the lower sleeve extension of an intermediate ring directly above rests on said inwardly extending annular shoulder and the downwardly facing shoulder of said intermediate ring directly above rests on an upper surface of said upper section forming said candle holder jar.

5. The combination package of claim 4 in which the central portion of each intermediate ring is of greater thickness than said sleeve extension, and the upper section is of greater thickness than said central portion.

6. The combination package of claim 5 in which said top ring has a flared upper opening to receive a cover for said jar.

* * * * *